US005342186A

United States Patent [19]

Swain

[11] Patent Number: 5,342,186

[45] Date of Patent: Aug. 30, 1994

[54] AXIAL ACTUATOR FOR UNLOADING AN ORBITAL SCROLL TYPE FLUID MATERIAL HANDLING MACHINE

[75] Inventor: James C. Swain, Columbus, Ohio

[73] Assignee: General Motors Corporation, Detroit, Mich.

[21] Appl. No.: 71,165

[22] Filed: Jun. 2, 1993

[51] Int. Cl.[5] ..... F01C 1/02

[52] U.S. Cl. ..... 418/55.5; 418/57; 418/14

[58] Field of Search ..... 418/55.4, 55.5, 57, 418/60, 14

[56] References Cited

U.S. PATENT DOCUMENTS

| | | | |
|---|---|---|---|
| 3,884,599 | 5/1975 | Young et al. | 418/57 |
| 4,575,318 | 3/1986 | Blain | 418/14 |
| 4,610,610 | 9/1986 | Blain | 418/14 |
| 4,877,382 | 10/1989 | Caillat et al. | 418/55 |
| 4,927,339 | 5/1990 | Riffe et al. | 418/55 |
| 4,990,072 | 2/1991 | Guttinger | 418/55.5 |

*Primary Examiner*—Richard A. Bertsch

*Assistant Examiner*—Charles G. Freay

*Attorney, Agent, or Firm*—Patrick M. Griffin

[57] ABSTRACT

A scroll type fluid displacement machine (10) with a housing (12) a fluid inlet port (78) and a fluid outlet port (76) has an annular piston (88) that biases the balls (90) of the ball coupler and the orbital scroll (29) toward the fixed scroll (18) to move the axial tips (40 and 58) of the wraps (34 and 52) into sealing contact with the end plates (30 and 48) when fluid is pumped into the annular chamber (120). A control system (28) is provided to control the axial position of the orbital scroll (20). The control system (28) includes a solenoid valve (176) which directs fluid from a small trigger compressor (174) to the annular chamber (120) to axially move the orbital scroll (20) into sealing contact with the fixed scroll (18). The solenoid valve (176) also directs fluid from the exhaust chamber (42) to the annular chamber (120) to maintain the orbital scroll (20) in sealing contact with the fixed scroll (18). The solenoid valve (176) also directs fluid from the annular chamber (120) to the sump (232) to stop fluid compression by the scrolls (18 and 20).

1 Claim, 3 Drawing Sheets

AXIAL ACTUATOR FOR UNLOADING AN ORBITAL SCROLL TYPE FLUID MATERIAL HANDLING MACHINE

TECHNICAL FIELD

This invention is in a scroll type fluid material handling machine and more specifically in a clutchless scroll type fluid material handling machine with a fixed scroll and an orbital scroll which compress, pump, expand or meter fluid material.

BACKGROUND OF THE INVENTION

Scroll type fluid material handling machines are commonly used to compress, pump, expand or meter fluids. These machines have a pair of scrolls with end plates and spiral wraps that cooperate to form a pair of fluid pockets. The fluid pockets move either toward the center of the end plates or toward the radially outer edge of the end plates depending upon the direction of orbital movement of one scroll relative to the other scroll. The orbital movement of one scroll relative to the other scroll can be obtained by rotating both scrolls about axes that are offset from each other or by holding one scroll in a fixed position and driving the other scroll in an orbit relative to the fixed scroll.

Scroll type fluid displacement machines which form fluid pockets and move the pockets toward the center of the scrolls are commonly used to compress fluid. As the fluid pockets move toward the center of the scrolls, the pockets decrease in volume thereby compressing the fluid they contain. The fluid pockets deliver the compressed fluid they contain to a discharge aperture at an elevated pressure near the center of the end plates. Such compressors are useful in various machines including refrigeration systems.

Scroll type compressors can be driven by a dedicated power source which drives only the compressor. When they are driven by a dedicated power source, the power source can be turned off when the compressor is not needed. Other scroll type compressors are driven by power sources that drive driven equipment other than the compressor. An example of such a compressor would be an air conditioning compressor for a vehicle with an electric motor or an internal combustion engine which provides power to propel the vehicle, to steer the vehicle, to brake the vehicle, and to operate other accessories. When a scroll compressor is driven by a power source that provides power for other functions, it is desirable and generally necessary to provide a separate clutch that allows the scroll type compressor to be disconnected when it is not needed. Substantial energy can be saved by disconnecting a compressor when the compressor is not needed.

Clutches for scroll type compressors can take many forms. The most common type clutch used to drive compressors on automotive vehicles are electromagnetic clutches. Electromagnetic clutches are relatively small, compact, reliable and efficient compared to some other clutches. However, an electromagnetic clutch attached to a scroll compressor substantially increases the size and weight of the compressor and drive clutch combination. An electromagnetic clutch is likely to be at least as large in diameter as a scroll type compressor that it drives. The electromagnetic clutch also increases the length of a clutch and compressor combination. In addition to being physically large, electromagnetic clutches have substantial weight. A lightweight scroll type compressor could weigh less than the electromagnetic clutch which drives it.

SUMMARY OF THE INVENTION

An object of the invention is to provide a clutchless scroll type fluid material handling machine.

Another object of the invention is to provide a clutchless scroll type fluid material handling machine which is reliable, light weight and small compared to similar capacity machines with clutches.

A further object of the invention is to provide a scroll type fluid material handling machine with a fixed scroll, an actuator which can permit axial separation of the orbital scroll from the fixed scroll to stop fluid displacement and which can axially bias the orbital scroll toward the fixed scroll to seal fluid pockets and enable fluid displacement.

The fluid displacement machine has a housing with a fluid inlet pore and a fluid outlet port. A fixed scroll with an end plate, an involute wrap with an inside flank, an outside flank and an axial tip, and a central port is mounted in a fixed position within the housing. An orbital scroll with an end plate and an involute wrap with an inside flank, an outside flank and an axial tip is inside the housing adjacent to the fixed scroll. The axial tips of the two scrolls are adjacent to the end plate of the adjacent scroll and the flanks of the orbital scroll wrap contact the flanks of the fixed scroll wrap to form at least one pair of sealed fluid pockets. A crankshaft is rotatably mounted in the housing and is connected to the end plate of the orbital scroll by an eccentric bushing. Rotation of the crankshaft drives the orbital scroll in a generally circular orbit and moves the fluid pockets radially toward the center of the scrolls or toward the outer edge of the scrolls depending upon the direction of rotation of the crankshaft. A ball coupler is positioned adjacent to the endplate of the orbital scroll. The ball coupler allows the orbital scroll to move in an orbital path while preventing rotation of the orbital scroll. A fluid actuator biases the balls of the ball coupler toward the orbital scroll to hold the axial tips of the wraps in contact with the adjacent end plate. Fluid can be released from the fluid actuator thereby allowing some axial displacement of the orbital scroll away from the fixed scroll.

Axial displacement of the orbital scroll away from the fixed scroll eliminates sealing between the axial tips of the wraps and the adjacent end plate. When sealing is eliminated, fluid displacement stops even though the orbital scroll continues to be driven in a generally circular orbit.

The foregoing and other objects, features and advantages of the present invention will become apparent in the light of the following detailed description of an exemplary embodiment thereof, as illustrated in the accompanying drawing.

DESCRIPTION OF THE PREFERRED EMBODIMENT

Figure 1:
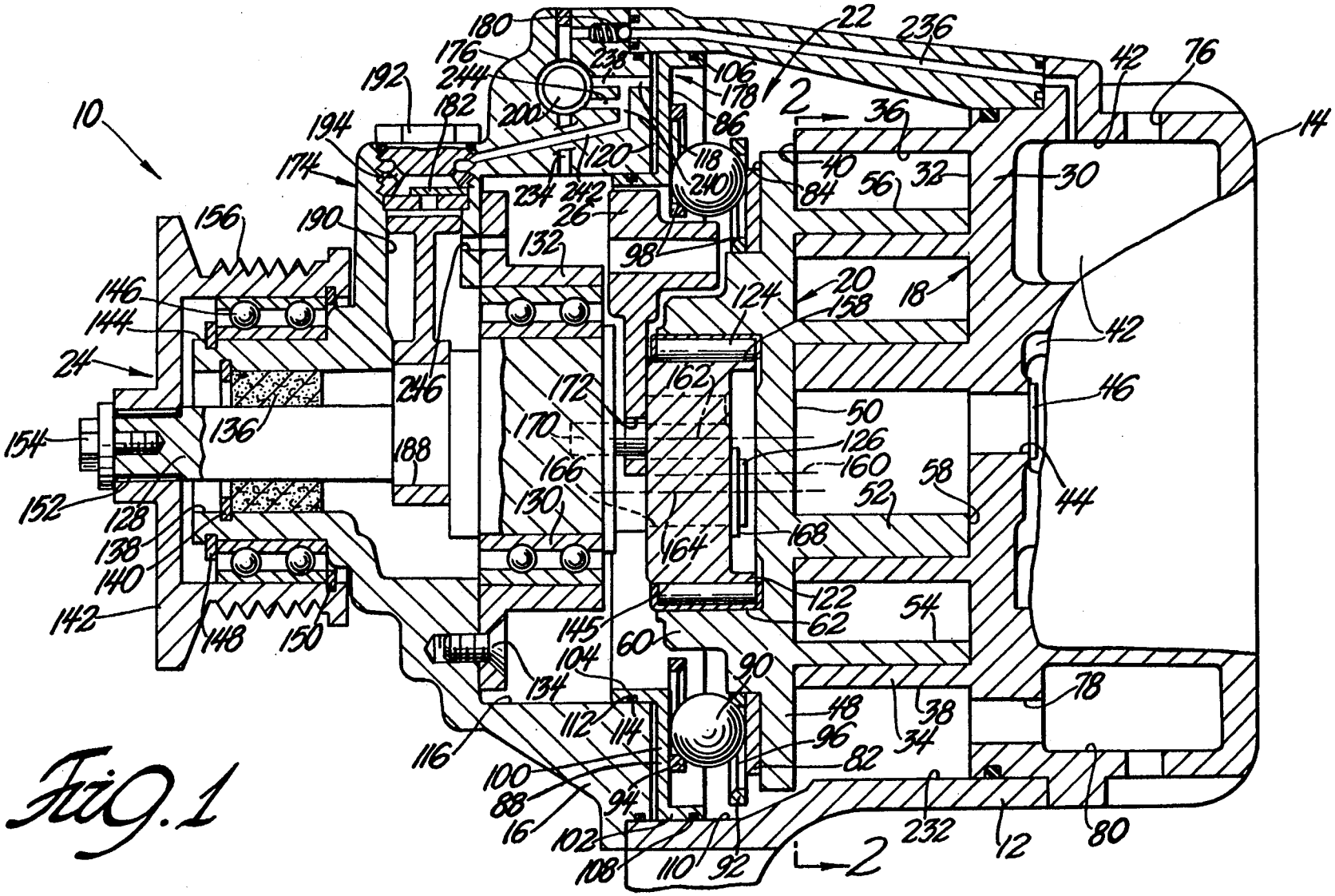
FIG. 1 is a vertical cross section through a clutchless scroll compressor.

The invention will be described as part of a scroll type compressor for convenience. The invention can be employed in other fluid displacement machines such as vacuum pumps, fluid pumps, fluid expanders and fluid metering machines as well as compressors as would be obvious to one with some knowledge concerning scroll type machines.

The scroll compressor 10 includes a housing 12 with a rear section 14 and a front section 16. The rear section 14 of the housing 12 has an integral fixed scroll 18. An orbital scroll 20 is orbitally mounted in the housing 12 to cooperate with the fixed scroll 18. An axial thrust and anti-rotation assembly 22 is mounted between the front section 16 of the housing 12 and the orbital scroll 20. A drive assembly 24 is mounted in the front section 16 of the housing 12 and is connected to the orbital scroll 20 to drive the orbital scroll in a generally circular orbit. A balance weight 26 radially balances orbital movement of the orbital scroll 20. A small amount of unbalance of the pulley 142 balances the rocking moment which results from the orbital scroll 20 and the balance weight 26 not being in the same transverse plane. A control system 28 is provided to move the orbital scroll 20 axially between a position in which the fixed scroll 18 and the orbital scroll 20 displace fluid and a position in which the scrolls do not displace fluid.

The fixed scroll 18 includes an end plate 30, with a flat surface 32 and an involute wrap 34. The involute wrap 34 has an inside flank 36, an outside flank 38 and an axial tip 40. The end plate 30 forms the front wall of an enclosed exhaust chamber 42. An exhaust aperture 44 provides a passage through the end plate 30 for the passage of fluid from the scrolls 18 and 20 to the exhaust chamber 42. A reed valve 46 is mounted inside the exhaust chamber 42 to allow free passage of fluid from the scrolls 18 and 20 to the exhaust chamber 42 and to prevent the flow of fluid from the exhaust chamber to the scrolls 18 and 20. As shown in FIG. 1, the reed valve 46 is closed. The reed valve 46 is forced open by fluid in the scrolls 18 and 20 when the fluid is at a pressure that exceeds the pressure of fluid in the exhaust chamber 42. The reed valve 46 is not employed in some fluid displacement machines such as fluid expanders.

The orbital scroll 20 includes an end plate 48 with a flat surface 50 and an involute wrap 52. The involute wrap 52 has an inside flank 54, an outside flank 56 and an axial tip 58. A boss 60 with a circular bore 62 is integral with the front side of the end plate 48.

The orbital scroll 20 may be anodized aluminum. The fixed scroll 18 may be aluminum that has not been anodized. A steel wear plate can be placed against the flat surface 32 of the end plate 30 if desired, to prevent wear of the flat surface 32 due to the axial tip 58 sliding in a generally circular orbit on the flat surface 32. A wear plate has not been shown in the drawing. The use of wear plates is common but not mandatory. A wear plate could also be mounted against the flat surface 50 on the end plate 48. Wear plates are not, however, generally required on anodized surfaces.

Figure 2:
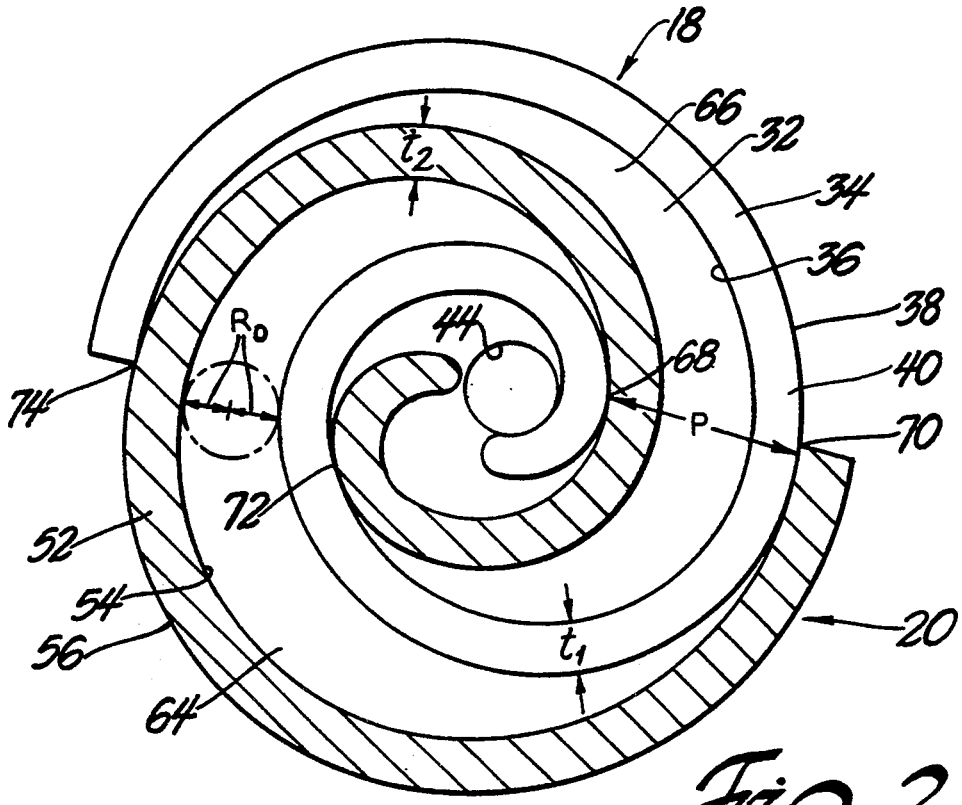
FIG. 2 is a cross sectional view of the scrolls taken along line 2—2 in FIG. 1.

The fixed scroll 18 and the orbital scroll 20 cooperate to form a pair of fluid pockets 64 and 66, as shown in FIG. 2. The fluid pocket 64 is bound by line contacts between the inside flank 54 of wrap 52 and the outside flank 38 of the wrap 34 along contact lines 68 and 70, by contact between the axial tip 40 and the flat surface 50 and by contact between the axial tip 58 and the flat surface 32. The fluid pocket 66 is bound by the line contacts between the inside flank 36 of the wrap 34 and the outside flank 56 of the wrap 52 along contact lines 72 and 74, by contact between the axial tip 40 and the flat surface 50 and by contact between the axial tip 58 and the flat surface 32. During operation of the scroll compressor 10, the orbital scroll 20 moves clockwise in a circular orbit with a radius $R_o$, as shown in FIG. 2. As the orbital scroll 20 moves in a circular orbit relative to the fixed scroll 18, the line contacts at 68, 70, 72 and 74 move along the surfaces of the flanks 36, 38, 54 and 56 toward the center of the scrolls. Movement of the contact lines 68, 70, 72 and 74 results in movement of the fluid pockets 64 and 66 toward the center of the scrolls 18 and 20. As the fluid pockets 64 and 66 move toward the center of the scrolls 18 and 20, they decrease in volume and the fluid in the pockets is compressed. When the fluid pockets 64 and 66 reach the center portion of the scrolls 18 and 20, they communicate with the exhaust aperture 44 and the compressed fluid in the fluid pockets is forced through the exhaust aperture and into the exhaust chamber 42. Compressed fluid in the exhaust chamber 42 flows from the exhaust chamber and out of the housing 12 through an outlet port 76.

Movement of the contact lines at 70 and 74 toward the center of the scrolls 18 and 20 from the locations shown in FIG. 2 starts the formation of new fluid pockets. These new fluid pockets suck fluid through a fluid inlet port 78 and out of an inlet chamber 80.

The fixed scroll 18 and the orbital scroll 20 have the same pitch P. The radius $R_o$ of the orbital scroll orbit where the thickness of the wrap 34 of the fixed scroll 18 is $t_1$ and the thickness of the wrap 52 of the orbital scroll 20 is $t_2$ is determined by the following equation:

$$R_o=(P-t_1-t_2)\times\tfrac{1}{2}$$

The pitch P for the scrolls 18 and 20 depends upon the diameter of the generating circle chosen for the involute wraps 34 and 52.

The axial thrust and anti-rotation assembly 22 includes a flat ring race 82 attached to a flat surface 84 on the front side of the end plate 48 of the orbital scroll 20 and a flat surface 86 on an annular piston 88. A plurality of thrust balls 90 are positioned between the flat ring race 82 and the flat surface 86 of the annular piston 88. The number of thrust balls 90 employed can vary. However, sixteen thrust balls 90 have been found to work well in some compressor designs. The axial thrust and anti-rotation assembly 22 further includes a pair of aperture rings 92 and 94. Each of the aperture rings 92 and 94 has 16 apertures 96 with a ball chamfer 98. The number of apertures 96 in each aperture ring 92 and 94 is equal to the number of thrust balls 90 and can be increased or decreased as required to accommodate the number of thrust balls employed. The aperture ring 92 is secured to the end plate 48 of the orbital scroll 20 adjacent to the flat ring race 82. The aperture ring 94 is attached to the annular piston 88. The apertures 96 and the ball chamfers 98 have diameters that allow the thrust balls 90 to travel in circular orbits relative to the flat ring race 82 and the flat surface 86 and allow the orbital scroll 20 to move in a circular orbit with an orbit radius of $R_o$. The apertures 96 and the ball chamfers 98 also cooperate with the thrust balls 90 to prevent rotation of the orbital scroll 20. With most scroll designs, the apertures 96 and ball chamfers 98 cooperate with the thrust balls 90 to allow the orbital scroll 20 to orbit in a circular orbit with a radius slightly larger than $R_o$ and thereby allow compensation for variations in the geometry of the wrap flanks 36, 38, 54 and 56.

The annular piston 88 includes a ring section 100, an outer tubular portion 102 and an inner tubular portion 104. The ring section 100 has the rear facing flat surface 86 that serves as a race for the thrust balls 90. The outer tubular portion 102 extends rearwardly from the ring section 100 and has an outer groove 106 for a seal 108 that seals against the inside wall 110 of the housing 12. The inner tubular portion 104 extends forwardly from the ring section 100 and has an outer groove 112 for a seal 114. The seal 114 seals against the inside wall of a bore 116 in the front section 16 of the housing 12. A passage 118 in the housing 12 supplies compressed fluid to an annular chamber 120 to move and bias the annular piston 88 to the rear. When compressed fluid is supplied to the annular chamber 120, the rear facing flat surface 86 forces the thrust balls 90 against the ring race 82 on the orbital scroll 20 and forces the axial tips 40 and 58 into sealing contact with the flat surfaces 32 and 50 on the end plates 30 and 48. When the axial tips 40 and 58 are in sealing contact with the flat surfaces 32 and 50 on the end plates 30 and 48, orbital movement of the orbital scroll 20 will displace fluid. The passage 118 in the housing 12 can also allow the escape of compressed fluid from the annular chamber 120. When the pressure of fluid in the annular chamber 120 decreases sufficiently, the orbital scroll 20 can move forward slightly and sealing between the axial tips 40 and 58 of the wraps 34 and 52 and the flat surfaces 32 and 50 of the end plates 30 and 48 is lost. When sealing is lost there are no sealed fluid pockets 64 or 66 and orbital movement of the orbital scroll 20 will not displace fluid.

The drive assembly 24 includes an eccentric bushing 122 that is rotatably journaled in the circular bore 62 in the boss 60 on the front of the orbital scroll 20 by a needle bearing 124. The eccentric bushing 122 receives the drive stud 126 of a crankshaft 128. The crankshaft 128 is rotatably journaled in a double ball bearing 130. The ball bearing 130 is pressed into the tubular portion of a bearing support flange 132. The bearing support flange 132 is secured in the front section 16 of the housing 12 by countersunk flat head machine screws 134. A seal 136 seals between the forward end of the crankshaft 128 and the bore 138. The seal 136 is retained in the bore 138 by a snap ring 140. A pulley 142 is rotatably journaled on a tubular portion 144 of the front section 16 of the housing 12 by a bearing 146. The bearing 146 is retained on the tubular portion 144 by a snap ring 148. The pulley 142 is retained on the bearing 146 by a snap ring 150. The pulley 142 has a central bore with splines 152 that engage splines on the forward end of the crankshaft 128 to rotate and support the crankshaft. The splines 152 on the crankshaft 128 and in the central bore in the pulley 142 both have missing spline portions that allow the pulley to be mounted on the crankshaft in one position only. By mounting the pulley 142 in one position only, weight can be added to or removed from the pulley to balance the rocking moment discussed above. The crankshaft 128 is axially restrained in the splines 152 by a bolt 154 that screws into a threaded bore in the crankshaft. The pulley 142 as shown, is designed to be driven by a power band belt that engages the V-grooves 156. The pulley 142 could be modified to be driven by a standard V-belt, by a chain, by gears or by some other type of torque transmission device.

The eccentric bushing 122 has a cylindrical outer surface 158, concentric with it's centerline 160, that contacts and rolls on the needles of the needle bearing 124. The crankshaft 128 has an axis of rotation 162. The drive stud 126 has an axis 164 which is congruent with the axis of the bore 166 in the eccentric bushing 122 in which the drive stud 126 is journaled. A c-clip 168 limits axial movement of the eccentric bushing 122 relative to the drive stud 126. The distance between the axis of rotation 162 of the crankshaft 128 and the centerline 160 of the eccentric bushing 122 is approximately equal to the orbit radius $R_o$ of the orbital scroll 20. By placing the axis 164 of the drive stud 126 further from the axis of rotation 162 of the crankshaft 128 than the centerline 160 of the eccentric bushing 122 and angularly displacing the axis of the drive stud in the direction of motion, the eccentric bushing becomes a swing link that allows some variation in actual orbit radius $R_o$ of the orbital scroll 20. This variation allows the actual orbit of the orbital scroll 20 to change to accommodate variations in scroll wrap flank profiles and to accommodate some foreign material between the scroll wrap flanks 36, 38, 54 and 56. The eccentric bushing 122, as described above, also tends to drive the wrap flanks 54 and 56 into contact with the wrap flanks 36 and 38 to improve sealing of the fluid pockets 64 and 66. A pin 170 is pressed into the crankshaft 128 and is loosely received in a bore 172 through the balance weight 26 attached to eccentric bushing 122. The pin 170 limits pivotal movement of the eccentric bushing 122 relative to the crankshaft 128.

Figure 3:
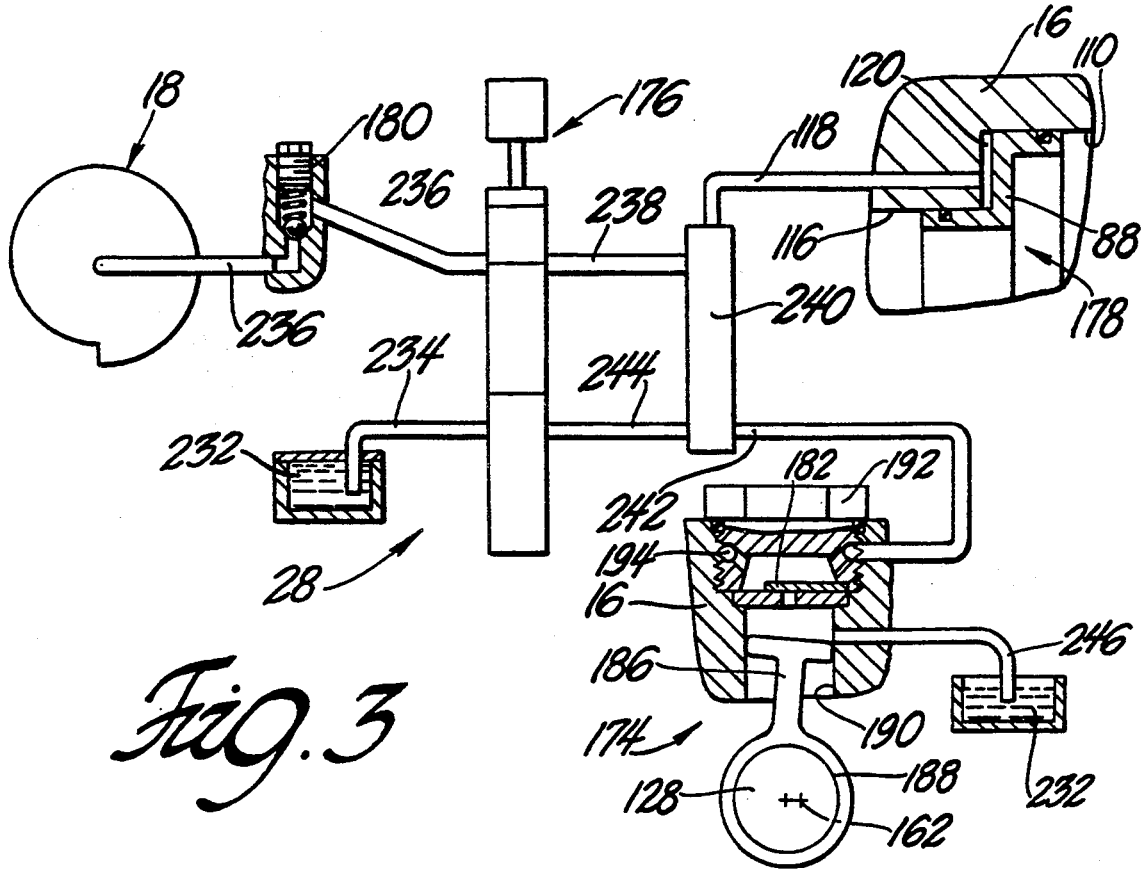
FIG. 3 is a schematic view of the control system for axially loading and unloading the orbital scroll.

The control system 28 for controlling the displacement of fluid is shown schematically in FIG. 3. The control system 28 includes a small trigger compressor 174, a solenoid valve 176, and actuator 178 and check valves 180, and 182. The small trigger compressor 174 includes a piston and connecting rod 186 connected to an eccentric cam 188 on the forward end of the crankshaft 128, and in a transverse bore 190 in the front section 16 of the housing 12. The transverse bore 190 is closed by a plug 192 with internal passages 194. The actuator 178 is defined by the annular piston 88, the cylindrical inside wall 110 and the bore 116 in the front section 16 of the housing 12 as described above.

The solenoid valve 176 includes a bore 196 and a bore 198 in the front section 16 of the housing 12. A valve spool 200 is axially moveable in the bore 196. The valve spool 200 is connected to a solenoid armature 202 by a connecting rod 204. The solenoid armature 202 is encased in a hermetic tube 206 that is clamped inside the bore 198 by a threaded ring-shaped fastener 208. An O-ring seal 210 is positioned between the bottom of the bore 198 and the open end of the hermetic tube 206 to prevent fluid leakage from the solenoid valve 176. A solenoid coil 212 is mounted inside the bore 198 and surrounds the hermetic tube 206. An armature return spring 214 is mounted in a bore 216 in the solenoid armature 202. A cap 218 closes the bore 198 and holds the solenoid coil 212 in the bore.

The valve spool 200 has two grooves 220 and 222 and three lands 224, 226 and 228. A bore 230 through the central portion of the valve spool 200 equalizes fluid pressure on both ends of the valve spool at all times. A sump 232 is formed by the inside portions of the housing 12 that enclose the scrolls 18 and 20, the axial thrust and anti-rotation assembly 22, the crankshaft 128 and the eccentric bushing 122.

A passage 236 connects the solenoid valve 176 to the exhaust chamber 42 and fluid that passes through the exhaust aperture 44 in the fixed scroll 18. A passage 238 connects the solenoid valve 176 to a gallery 240. The gallery 240 is connected to the actuator 178 by a passage 118. A passage 242 connects the discharge of the small trigger compressor 174 to the gallery 240. A passage 244 connects the gallery 240 to the solenoid valve 176. A passage 246 connects the fluid inlet of the small trigger compressor 174 to the sump 232. A passage 234 allows fluid to flow from the compressor 174 or the actuator 178 through the valve 176 to the sump 232.

Figure 4:
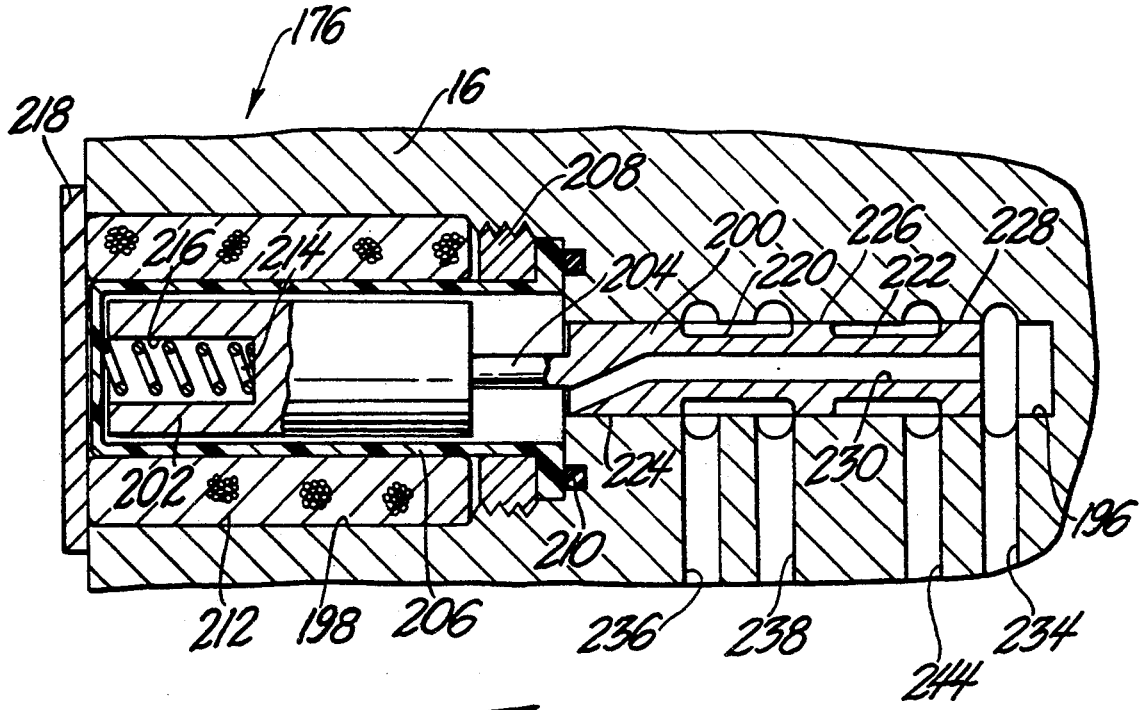
FIG. 4 is a cross sectional view of the solenoid actuated valve portion of the control system.

To deactivate the compressor 10, the solenoid coil 212 is de-energized and the armature return spring 214 forces the solenoid armature 202 to the right from the position shown in FIG. 4. When the valve spool 200 is moved to the right land 224 closes the passage 236 and the groove 222 connects the passage 234 to passage 244. This allows fluid in the actuator 178 to flow to the gallery 240, fluid from the small trigger compressor 174 to flow to the gallery and fluid in the gallery to pass through the passage 244 and through the passage 234 to the sump 232. The drop in the pressure of fluid in the actuator 178 allows the orbital scroll 20 to move axially away from the fixed scroll 18. When the orbital scroll 20 has moved to a point in which there is no sealing of the fluid pockets 64 and 66 between the end plates 30 and 48 and the axial tips 40 and 58 of the wraps 34 and 52, the scrolls will stop compressing fluid.

To activate the compressor 10, the solenoid coil 212 is energized and the solenoid armature 202 is forced to the left to the position shown in FIG. 4. When the valve spool 200 is moved to the left, the groove 220 connects the passage 236 with the passage 238 and the land 228 blocks a connection between the passage 234 and the passage 244. Blocking the passage 244 blocks the passage of fluid from the gallery 240 to the sump 232. The small trigger compressor 174 continues to draw fluid from the sump 232 through the passage 246 and to force fluid into the gallery 240 through passage 242. Fluid passes from the gallery 240 through a passage 118 and into the annular chamber 120. When the pressure of fluid in the annular chamber 120 increases to the point that the annular piston 88 moves the orbital scroll 20 axially into sealing contact with the fixed scroll 18, the scrolls start to compress fluid. Compressed fluid from the exhaust chamber 42 will pass through the passage 236, through the groove 220 in the valve spool 200, through the passage 238 to the gallery 240 and through the passage 118 to the annular chamber 120. The pressure of fluid supplied to the annular chamber 120 from the exhaust chamber 42 is generally proportional to the pressure of fluid in the fluid pockets 64 and 66. The axial force exerted on the orbital scroll 20 by the annular piston 88 due to the pressure of fluid in the annular chamber 120 is adequate to insure sealing between the axial tips 40 and 58 and the flat surfaces 32 and 50. When pressure in the fluid pockets 64 and 66 drops due to a change in operating conditions of the compressor 10, fluid pressure in the annular chamber 120 will also drop due to decreased pressure in the exhaust chamber 42 and leakage in the solenoid valve 176 and the actuator 178. By avoiding excessive fluid pressure in the annular chamber 120, scroll wear is minimized and the life of the compressor 10 is increased.

The check valve 180 in the passage 236 is required to prevent the flow of fluid from the gallery 240 to the exhaust chamber 42. The check valve 180 allows the small trigger compressor 174 to axially move the orbital scroll 20 into sealing engagement with the fixed scroll 18 to start a fluid compressing action and maintains the sealing engagement until there is adequate fluid pressure in the discharge chamber 42. The check valve 182 prevents the loss of fluid from the main compressor 10 via the gallery 240 to the small trigger compressor 174. The check valve 182 is also necessary for proper functioning of the small trigger compressor 174. When fluid pressure in the gallery 240 is relatively high due to fluid from the scrolls 18 and 20 passing through passages 236 and 238 to the gallery, fluid pressure in the small trigger compressor 174 will remain high and the quantity of fluid drawn in from the sump 232 through passage 246 will decrease.

Thermal expansion of the scrolls 18 and 20 in the axial direction is accommodated by movement of the annular piston 88. The annular piston 88 maintains an axial load on the scrolls which is directly proportional to the pressure of fluid in the annular chamber 120 and is not dependent upon the axial position of the orbital scroll end plate 48. The ability of the orbital scroll 20 to move axially to accommodate thermal expansion while maintaining contact between the wrap tips 40 and 48 and the flat surfaces 32 and 50 allows the elimination of axial tip seals.

The preferred embodiment of the invention has been described in detail but is an example only and the invention is not restricted thereto. It will be easily understood by those skilled in the art that modifications and variations can easily be made within the scope of this invention.

What is claimed is:

1. A scroll type fluid material handling machine with a housing that has a fluid inlet, a fluid outlet, a fluid inlet chamber, and a fluid outlet chamber; a stationary scroll with an end plate and a wrap having inside and outside flanks and an axial tip mounted in the housing; an orbital scroll with an end plate and a wrap having inside and outside flanks and an axial tip mounted in the housing; a drive assembly for driving the orbital scroll in a generally circular orbit including a crankshaft rotatably mounted in the housing for rotation about an axis; an annular piston mounted in the housing for movement parallel to the axis about which the crankshaft rotates; a ball coupler including an aperture ring with a plurality of ball apertures connected to the orbital scroll, an aperture ring with a plurality of ball apertures connected to the annular piston, a plurality of thrust balls each of which is in a ball aperture in the aperture ring connected to the orbital scroll and in a ball aperture in the aperture ring attached to the annular piston; and a control system operable to supply fluid to move the annular piston toward the thrust balls and thereby move the axial tips of the wraps into sealing contact with the scroll end plates and operable to discharge fluid to allow the annular piston and the orbital scroll to move axially away from the stationary scroll.

* * * * *